United States Patent [19]

Fratti et al.

[11] Patent Number: 4,811,532

[45] Date of Patent: Mar. 14, 1989

[54] CASING WITH FIXED AND/OR MOVABLE FRAMES FOR DOORS, WINDOWS AND THE LIKE

[76] Inventors: Marco Fratti, Via Laveno, 6, Milan; Marco Mattiolo, Via S. Rocco 1, Ceranova, Province of Pavia, both of Italy

[21] Appl. No.: 941,677

[22] Filed: Dec. 15, 1986

[30] Foreign Application Priority Data

Dec. 20, 1985 [IT] Italy ..... 23343 A/85
Feb. 20, 1986 [IT] Italy ..... 19476 A/86

[51] Int. Cl.[4] ..... E06B 7/12

[52] U.S. Cl. ..... 52/172; 52/475; 52/656

[58] Field of Search ..... 52/172, 788, 656, 475–477, 52/397, 398, 307, 308, 172, 656, 475; 49/501, 400; 29/155 R

[56] References Cited

U.S. PATENT DOCUMENTS 834,968 11/1906 Christenson ..... 52/788
3,899,858 8/1975 Zanker ..... 52/172
4,109,432 8/1978 Pilz ..... 52/172
4,240,765 12/1980 Offterdinger ..... 29/155 R
4,552,790 11/1985 Francis ..... 428/34

FOREIGN PATENT DOCUMENTS 3516875 11/1986 Fed. Rep. of Germany ..... 52/172
1124367 8/1968 United Kingdom ..... 49/501

*Primary Examiner*—James L. Ridgill, Jr.
*Attorney, Agent, or Firm*—Modiano & Associates

[57] ABSTRACT

The present invention relates to a casing with fixed and/or movable frames for doors, windows and the like, which has the peculiarity of comprising a self-supporting frame having a perimetral framework with a closed shape provided with sections of profiled elements having a central body defining, on opposite sides, abutment regions for the fixing of the perimetral region of two spaced apart pane-like elements which provide a double-glazing. The sections of profiled elements, in their central portion, external to the extension of the perimetral framework, have at least portions prearranged for the coupling of means for connecting to a fixed framework.

5 Claims, 4 Drawing Sheets

CASING WITH FIXED AND/OR MOVABLE FRAMES FOR DOORS, WINDOWS AND THE LIKE

BACKGROUND OF THE INVENTION

The present invention relates to a casing with fixed and/or movable frames for doors, windows and the like.

As is known, aluminum casings are generally provided by means of a fixed framework which is connected to the supporting structure and supports fixed or, if required, movable frames.

The fixed frames and the movable frames are generally provided by means of profiled elements in aluminum, wood or other materials, which support in their interior a double-glazing.

Two kinds of double-glazing are currently available on the market, the so-called "thermopane"and the glass-chamber. In the "thermopane", the two panes of glass are glued to a metal profiled element by means of adhesive materials which are moisture-proof and simultaneously have characteristics of mechanical resistance sufficient to provide a lasting coupling.

In the glass-chamber, the glass panes are connected to the frame by means of an adhesive which ensures an absolute seal against moisture, while the mechanical coupling between the panes and the framework is obtained by means of another adhesive material which is applied in the region of the glass panes which is slightly protruding with respect to the dimensions of the inner framework.

Both kinds of double-glazing described above may be provided with glass panes which have identical or different thicknesses, according to the thermoacoustic requirements, and are applied as if they were a simple glass pane inside a fixed frame or a movable frame which has a supporting function.

As is obvious, this embodiment implies significantly high costs both for the manufacture of the double-glazing and for the subsequent manufacture of the frame which must couple to the double-glazing.

SUMMARY OF THE INVENTION

The aim proposed by the invention is indeed to eliminate the above described disadvantages by providing a casing for all the possibilities of use, i.e. for windows or doors with one or more shutters, horizontally rotating windows or outward-swinging windows, horizontal or vertical bascule doors or windows, sliding or blind-type doors or windows, windows with a fixed pane and wall faces generally, which allows the possibility of significantly simplifying all the manufacturing operations.

Within the scope of the above described aim, a particularly object of the invention is to provide a casing in which the fixed and/or movable frame in practice constitutes an integral part of the double-glazing, thus, in practice, allowing the elimination of one frame with respect to the conventional solutions.

Still another object of the present invention is to provide a casing which allows the possibility of reducing the amount of aluminum required to produce the casing, also having the advantage of practically eliminating all the mechanical machining required for installation.

A further object of the present invention is to provide a double-glazing as a self-supporting panel, without therefore the need to provide, according to the prior art, a metal or wood frame in which to insert subsequently the double-glazing, thus simplifying significantly all the operations of manufacture and installation.

Not least object of the present invention is to provide a casing which is very competitive from a merely economical point of view and which can be easily used even in the case of replacement of already-existing structures, since it can be applied from the inside without the need for access to outer structures, using the already-existing fixed framework for fixing the replacement element.

The above described aim, as well as the objects mentioned and others which will become apparent hereinafter, are achieved by a casing with fixed and/or movable frames for doors, windows and the like, according to the invention, characterized in that it comprises a self-supporting frame having a perimetral framework with a closed shape provided with sections of profiled element having a central body defining, on opposite sides, abutment regions for the fixing of the perimetral region of two pane-like spaced apart elements which provide a double-glazing, said sections of profiled element, in their central portion, external to the extension of said perimetral framework, have at least portions prearranged for the coupling of means for connecting to a fixed framework.

BRIEF DESCRIPTION OF THE DRAWINGS

Further characteristics and advantages will become apparent from the description of some preferred, but not exclusive, embodiments of a casing with fixed and/or movable frames for doors, windows and the like, illustrated only by way of non-limitative example in the accompanying drawings, wherein.

DESCRIPTION OF THE PREFERRED EMBODIMENTS

Figures 1, 2, 5:
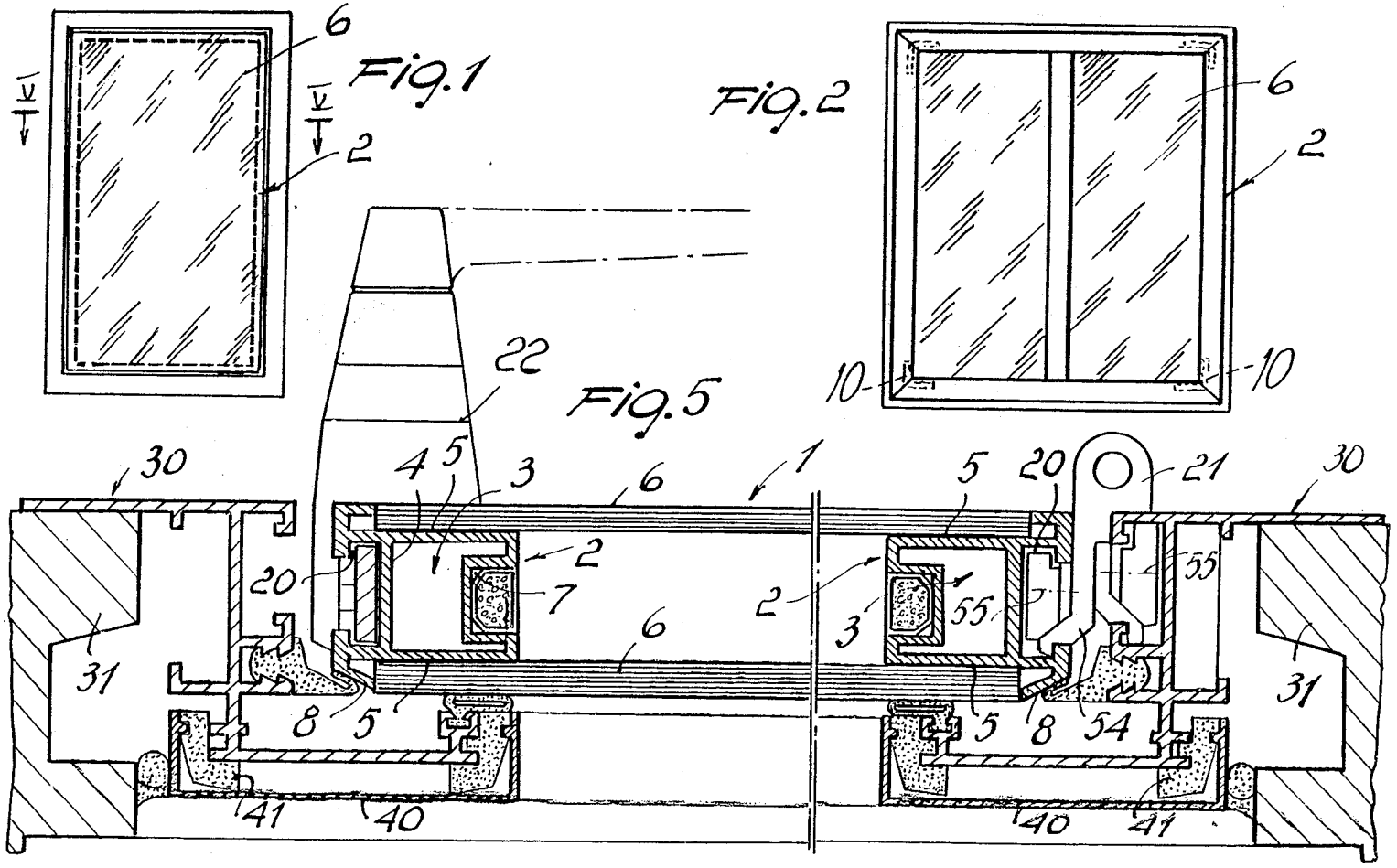
FIG. 1 is a schematic view of a casing with one movable shutter, seen from the inside.
FIG. 2 is a schematic view of a casing having one fixed shutter and one movable shutter, seen from the outside.
FIG. 5 is a schematic cross section view along the line V—V of FIG. 1.
Figure 3:
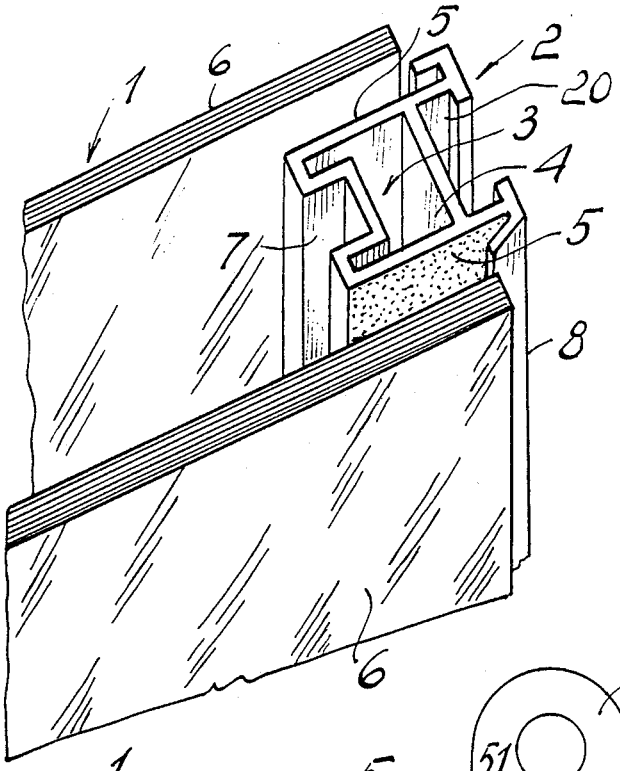
FIG. 3 is an exploded perspective view of the structure of the self-supporting frame, with double-glazing of the thermopane type.
Figure 4:
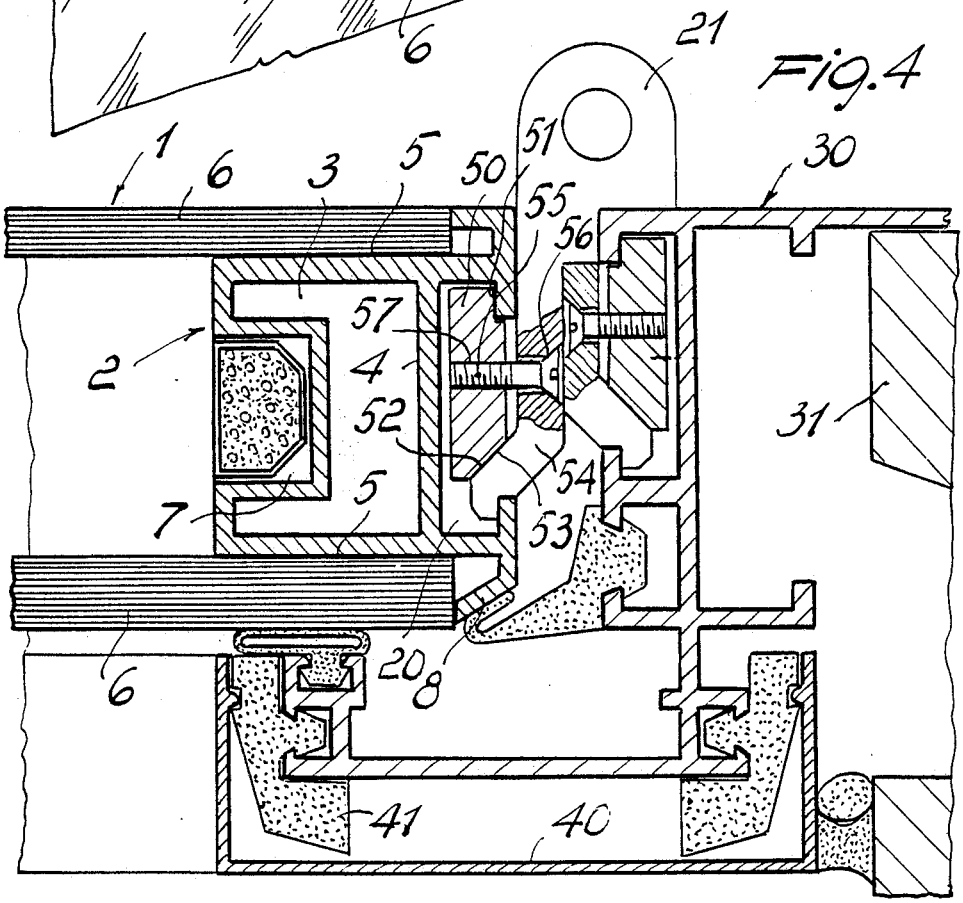
FIG. 4 illustrates the casing in cross section, in the region of the coupling of the hinges.

With reference to the FIGS. 1–5, the casing with fixed and/or movable frames for doors, windows and the like, according to the invention, comprises a self-supporting frame, generally indicated with the reference numeral 1, which can be used both as a fixed shutter and as a movable shutter, which is provided with a perimetral framework made of section of profiled element 2.

The profiled elements 2 define a central body 3 having an internal closed cavity 4. The central body 3 defines, on opposite sides, regions 5 which act as abutment regions for the fixing of the perimetral region of pane-like glass elements 6. The pane-like glass elements 6 are coupled to the profiled element 2 by gluing at the abutment region, which gluing achieves the sealing, the moisture-proofing, and the mechanical coupling, thus obtaining a glass pane of the thermopane type.

The central body 3 defines on its edge internal to the region defined by the two panes 6 which provide the double glazing, a recess 7 for the accommodation of the usual cartridges of gel for absorbing the moisture, if any, of the interspace provided between the pane-like elements 6.

The profiled element 2 is furthermore provided, on its outer edge, with tabs 8 which engage with the edge of the pane-like elements, thus in practice constituting a completing and positioning element for the panes.

The framework composed of the profiled elements 2 is provided by cutting at 45° the ends of the individual profiled elements and joining them by means of connecting plates 10 which insert into the cavity 4 and are fixed by mechanical deformation of the profiled element, thus providing the framework without using screw-like fixing means or the like.

Once the framework has been provided, the panes 6 are applied by gluing, which panes confer to the assembly the desired mechanical strength.

Said profiled element 2 is furthermore provided on the outer edge with a seat, indicated with the reference numeral 20, which has the function of allowing the coupling of the means for connecting to the fixed framework. The connecting means may be composed of the hinges, indicated with 21 in the drawings, of the closing handle 22, or of other engagement means, if any, if the self-supporting frame is used as a fixed shutter.

As is schematically illustrated in the drawings, said connecting means interact between the self-supporting frame 1 and a fixed framework which is composed of a profiled element 30 fixed to the fixed structure, indicated with the reference numeral 31.

The profiled element 30 of the fixed framework provides, in a per se known manner, the seats for the coupling of the usual sealing gaskets which interact with the self-supporting frame which is provided in the previously described manner.

It is also furthermore possible to provide a covering frame, composed of covering profiled elements 40 which couple with a tab of the fixed-framework profiled element 30, by means of spacers 41 in thermally insulating material, thus obtaining a thermal cut for the casing.

Another characteristic of the invention is furthermore constituted by the fact that the connection of the various connecting means in the seat 20 can be obtained without boring holes or the like.

As an example, as is indicated for the application of the hinge 21, the fixing means may be composed of a first block 50 accommodated in the seat 20 and having an abutment edge 51 which can be coupled inside the seat and, on the other side, with a sloping edge 52, which can be coupled by contact with a sloping plane 53 defined by an arm 54 of the hinge 21.

A countersunk-head locking screw 55 is furthermore provided, which engages in a conical hole 56 provided on the arm 54 and screws into a threaded seat 57 defined by the small block 50.

The tightening of the small block 50 against the arm 54, which is performed by means of the screw 55, causes a sliding of the sloping planes 52 and 53 with the consequent tightening inside the seat, thus obtaining the fixing of the hinge, and of other accessories if required, without having to bore holes or perform other complicated processes.

It should be furthermore noted that with the embodiment described it is possible to obtain a double glazing which, besides being self-supporting and therefore acting in itself as a frame for the casing, is obtainable with a slightly greater thickness with respect to the conventional thicknesses, with remarkable improvement regarding the thermo-acoustic insulating characteristics.

Figure 6:
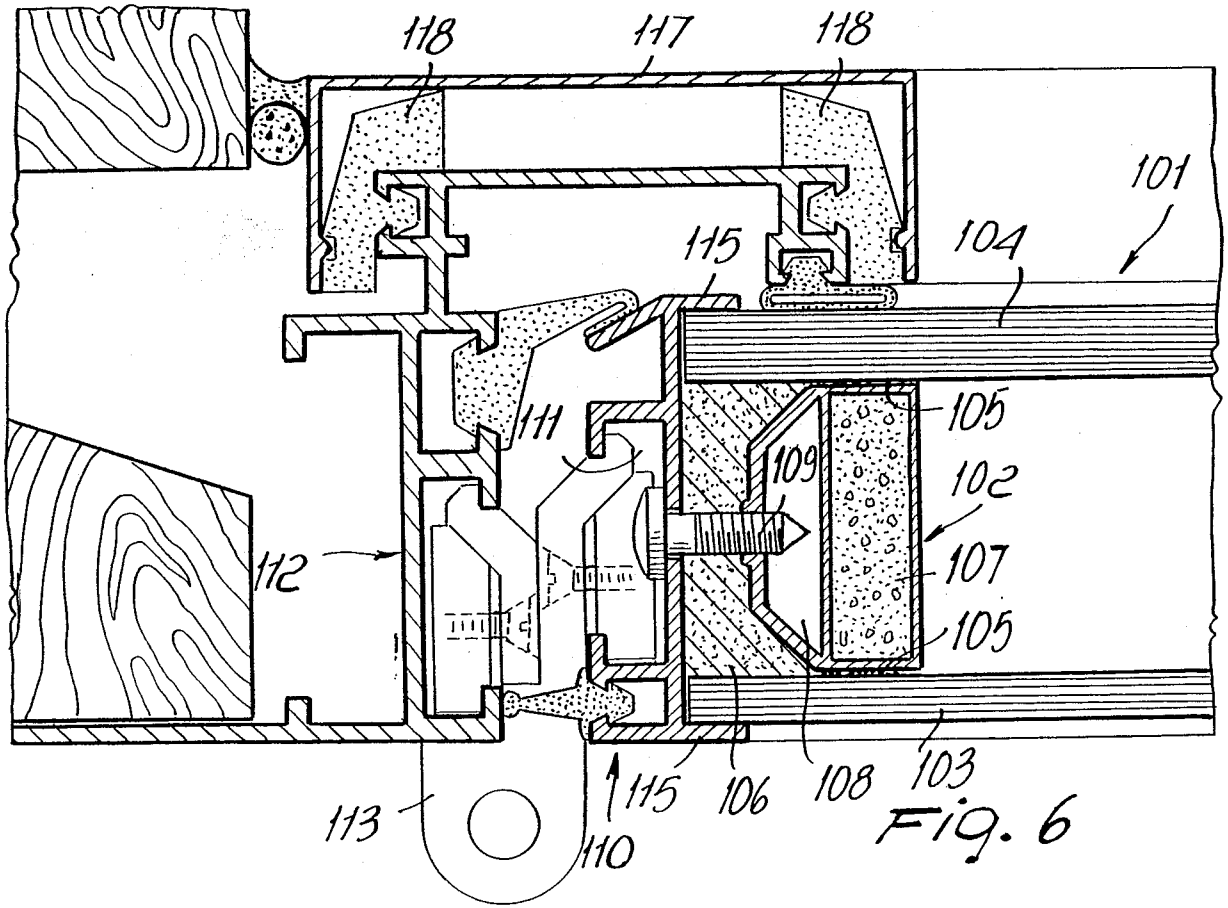
FIG. 6 is a cross section view of a glass-chamber, illustrating the peculiar configuration of the profiled element composing the perimetral framework.
Figure 7:
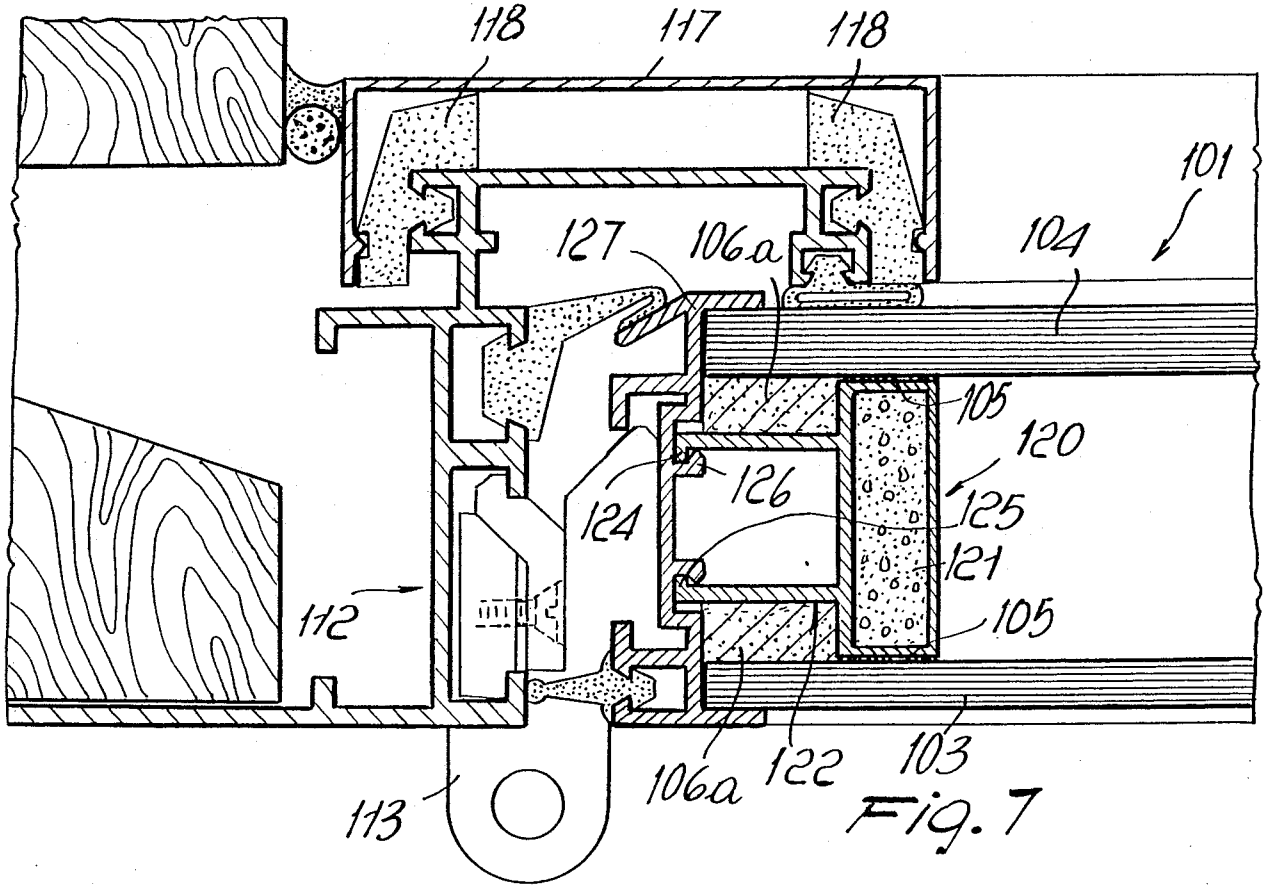
FIG. 7 is a cross section view of a glass-chamber inserted in a casing with a covering profiled element at the perimetral edges.

According to what has been illustrated in FIGS. 6 and 7, it is also possible to obtain double-glazing of the glass-chamber type, indicated generally with the reference numeral 101, which is composed of a framework with a closed shape, produced by means of profiled elements, generally indicated with the reference numeral 102, to which glass panes 103 and 104 are connected which couple to the sides of the profiled element 102 by means of a layer 105 of waterproofing material which prevents any inward infiltration of moisture.

The panes 103 and 104 protrude with respect to the framework composed of the profiled elements 2, so as to define around the same framework a seat in which it is possible to introduce, in a per se known manner, an adhesive material, indicated with the reference numeral 106, which performs the mechanical coupling between the panes 103 and 104 and the profiled element 102.

The peculiarity of the profiled element 102 is constituted by the fact that at the outer edge, portions are provided which are prearranged for the coupling of elements for connection to an outer frame.

More precisely, the profiled element 102, which composes the framework, has a first chamber 107 arranged inwards, in which, in a per se known manner, dehumidifying materials or products are introduced; on the outer side of the first chamber 107 a second chamber 108 is defined which has the function, besides that of mechanically stiffening the profiled elements and therefore rendering the frame self-supporting, also that of allowing the fixing of self-threading screws 109 which allow one to fix to the glass-chamber thus provided, some profiled elements, which are generally indicated with the reference numeral 110 and compose an outer frame which in practice is supported by the glass-chamber, this being the reverse of what is currently found in the production of casings in which the casing has a frame in which the glass-chamber is applied as if it were an ordinary pane of glass.

The outer profiled element 110 defines, on the outer side, a seat 111 for the coupling of the accessories for the connection to the fixed framework, schematically indicated with 112.

The accessories for coupling may be composed of the usual hinges, indicated by the reference numeral 113 in the drawing, or of any other element, such as handles and the like, which are normally applied to the casing.

The outer profiled element 110 is provided with tabs 115 which overlap at the perimetral edge of the glass panes 103, and 104, thus acting as a finishing element.

For the sake of completeness of description, it should be furthermore added that a covering profiled element 117 can be provided, applied by means of spacers 118 in a thermally insulating material which coupled in a snap-together manner with the profiled element of the fixed framework 112 to complete the profiled element with the provision of the so-called thermal cut.

With explicit reference to FIG. 7, an embodiment is illustrated which is conceptually similar to the one described previously with a different embodiment of the profiled element composing the framework itself.

The profiled element, now indicated with the reference numeral 120, is also provided with an internal chamber 121 for introducing the dehumidifying materials and with an outer region 122 which is, at its outer edge, at a level or slightly protruding with respect to the outer edges of the glass panes 103 and 104.

In the outer region 122, are defined opposed tabs 125 which define a coupling seat in which coupling teeth 126 are engageable for connecting an outer covering profiled element 127 which has the function of covering the outer edges of the glass panes. The accessories, such as hinges and the like, are connected directly, by means of known coupling means, in the outer region 122 passing through the outer covering profiled element 127.

In this case, the adhesive material, indicated with **106*a*, is in practice accommodated in two separate regions, which in practice perform the coupling of a pane to the profiled element 120 and of the other pane to the profiled element 120, since the chamber 122** in practice divides the seat which is created perimetrally on the glass-chamber for the introduction of the adhesive material.

From what has been described, it can thus be seen that the invention achieves the intended aims and in particular the fact is stressed that a double glazing is provided which constitutes a self-supporting panel to which it is possible to connect, in a very quick and simple manner, an outer containment frame which is supported by the double glazing and is preset for a quick and easy connection thereof to the fixed framework, thus significantly simplifying all the operations related thereto.

To what has been said it should be furthermore added that the outer profiled element can be provided in any material such as aluminum, steel, metallic materials in general, wood and so on, since the modification in the material changes nothing of the inventive concept.

The invention is susceptible of numerous modifications and variations, all of which are within the scope of the inventive concept.

Furthermore, all the details can be replaced by technically equivalent elements.

In practice, the materials employed, so long as compatible with the specific use, as well as the contingent shapes and dimensions, may be any according to the requirements.

I claim:

1. Casing structure for windows, doors and the like comprising profiled elements defining a perimetral framework and each having a central body and ends, an inner edge and an outer edge defined on said central body, -abutment regions defined on said central body and extending between said inner edge and said outer edge, a recess defined at said inner edge, a gel cartridge accommodated in said recess, two pane -like glass elements, perimetral regions defined by said pane-like glass elements and engaging with said abutment regions so as to enclose said recess and said gel cartridge between said two pane-like glass elements, edges defined by said pane-like glass elements, tabs extending from said outer edge of said central body and engaging said edges of said pane-like glass elements, a cavity defined in said central body of each of said profiled elements, connection elements inserted into said cavity from said ends of said profiled elements for connecting said profiled elements together to define said perimetral framework, wherein said connection elements cause mechanical deformation of said profiled elements upon being inserted into said cavity, and wherein said perimetral regions of said pane-like glass elements are glued to said abutment regions of said central body such that said pane-like glass elements confer mechanical strength to said casing structure.

2. In combination, a casing structure and means for connecting the casing structure to a fixed framework, particularly for windows, doors and the like, said casing structure comprising, profiled elements defining a perimetral framework and each having a central body and ends, an inner edge and an outer edge defined on said central body, abutment regions defined on said central body and extending between said inner edge and said outer edge, a recess defined at said inner edge, a seat defined at said outer edge, a gel cartridge accommodated in said recess, two pane -like glass elements, perimetral regions defined by said pane-like glass elements and engaging with said abutment regions so as to enclose said recess and said gel cartridge between said two pane-like glass elements, edges defined by said pane-like glass elements, tabs extending from said outer edge of said central body and engaging said edges of said pane-like glass elements, a cavity defined in said central body of each of said profiled elements, connection elements inserted into said cavity from said ends of said profiled elements for connecting said profiled elements together to define said perimetral framework, wherein said connection elements cause mechanical deformation of said profiled elements upon being inserted into said cavity, and wherein said perimetral regions of said pane-like glass elements are glued to said abutment regions of said central body such that said pane-like glass elements confer mechanical strength to said casing structure, said means for connecting said casing structure to a fixed framework comprising a hinge adapted to be connected to a fixed framework and having an arm defining a sloping plane, a first block having an abutment edge coupled in said seat and a sloping edge coupled to said sloping plane, a hole formed in said arm a threaded seat formed in said block a locking screw inserted into said hole and engaging said threaded seat, wherein tightening of said screw causes sliding movement of said sloping edge and said sloping plane thereby tightening said block within said seat.

3. In combination, a casing structure and means for connecting the casing structure to a fixed framework, particularly for windows, doors and the like, said casing structure comprising, first profiled elements defining an outer frame and each having an outer side and an inner side, at least one coupling seat defined on said outer side of each of said first profiled elements and being adapted for cooperation with means for coupling said casing structure to a fixed framework, second profiled elements each having two sides and extending parallel to said inner side of said first profiled elements inside said outer frame, layers of waterproofing material located on said two sides of each of said second profiled elements, two pane like glass elements having perimetral edges, and portions abutting said layers of waterproofing material, perimetral edges defined by said pane-like glass elements, tabs extending from said outer frame defined by said first profiled elements and engaging said perimetral edges of said pane-like glass elements, at least one seat defined perimetrally between said inner side of said first profiled elements and said second profiled element, and being laterally delimited by said pane-like glass elements, adhesive material accommodated in said seat and coupling said two pane-like glass elements to said second profiled elements, at least one first chamber defined in each of said second profiled elements, dehumidifying material accommodated in said first chamber, at least one second chamber defined in each of said second profiled elements, connection means extending across said seat and connecting said outer frame defined by said first profiled elements to said second chamber of said second profiled elements, said means for connecting said casing structure to a fixed framework comprising, a hinge adapted to be connected to a fixed framework and having an arm defining a sloping plane, a first block having an abutment edge coupled in said seat and a sloping edge coupled to said sloping plane, a hole formed in said arm a threaded seat formed in said block a locking screw inserted into said hole and engaging said threaded seat, wherein tightening of said screw causes sliding movement of said sloping edge and said sloping plane thereby tightening said block within said seat.

4. Casing structure for windows, doors and the like acording to claim 3, wherein said connection means comprise self-threading screws.

5. Casing structure for windows, doors and the like according to claim 3, wherein said connection means comprise coupling tabs rigidly associated with said second profiled elements and extending across said seat, and coupling teeth rigidly associated with said first profiled elements, said coupling teeth engaging said coupling tabs thereby connecting said first profiled elements to said second profiled elements.

* * * * *